US010213023B2

(12) United States Patent
Yang

(10) Patent No.: US 10,213,023 B2
(45) Date of Patent: Feb. 26, 2019

(54) FOLDING ROCKING CHAIR

(71) Applicant: Zhejiang Hengfeng Top Leisure Co., Ltd., Zhejiang (CN)

(72) Inventor: Baoqing Yang, Hangzhou (CN)

(73) Assignee: ZHEJIANG HENGFENG TOP LEISURE CO., LTD., Zhejiang (CN)

( * ) Notice: Subject to any disclaimer, the term of this patent is extended or adjusted under 35 U.S.C. 154(b) by 43 days.

(21) Appl. No.: 15/466,990

(22) Filed: Mar. 23, 2017

(65) Prior Publication Data

US 2018/0271290 A1 Sep. 27, 2018

(51) Int. Cl.
*A47C 4/28* (2006.01)
*A47C 3/029* (2006.01)

(52) U.S. Cl.
CPC ..... *A47C 4/286* (2013.01); *A47C 3/029* (2013.01)

(58) Field of Classification Search
CPC ..... A47C 4/286; A47C 3/029
USPC ..... 297/16.1, 16.2, 35, 42, 45, 46, 271.5, 297/271.6, 258.1, 32, 272.1, 31, 39, 40, 297/43, 44, 55, 56, 29, 33, 378.1, 133, 297/131, 132, 143, 259.1
See application file for complete search history.

(56) References Cited

U.S. PATENT DOCUMENTS

| | | | | |
|---|---|---|---|---|
| 136,099 | A | 2/1873 | Russell | |
| 1,782,763 | A | 11/1930 | Overbey | |
| D179,878 | S | 3/1957 | Bernier | |
| 2,879,831 | A | 3/1959 | Williamson | |
| 3,114,572 | A * | 12/1963 | Hopkins | A47C 3/029 297/133 |
| 5,560,675 | A | 10/1996 | Altheimer et al. | |
| 5,702,152 | A | 12/1997 | Shaw | |
| 6,398,297 | B1 * | 6/2002 | Cantwell | A47C 3/029 297/133 |
| 6,439,656 | B1 * | 8/2002 | Liu | A47C 3/029 297/271.6 |
| 7,100,975 | B1 * | 9/2006 | Zheng | A47C 3/029 297/271.6 |
| 2003/0214159 | A1 * | 11/2003 | Brandschain | A47C 3/029 297/32 |
| 2014/0232154 | A1 * | 8/2014 | Chen | A47C 3/02 297/271.1 |

* cited by examiner

*Primary Examiner* — Mark R Wendell
(74) *Attorney, Agent, or Firm* — Thompson Coburn LLP

(57) ABSTRACT

A collapsible rocking chair adapted and configured to adjust between an expanded configuration and a collapsed configuration includes a pair of front cross members, a pair of rear cross members, a pair of rear seat support members, a pair of roll tubes, a left side member, a right side member, a left front seat support member, a right front seat support member, a right guiding member, and a left guiding member. The left guiding member is pivotally coupled to the left front seat support member and to the left roll tube between the first and second ends of the left roll tube. The right guiding member is pivotally coupled to the right front seat support member and to the right roll tube between the first and second ends of the right roll tube.

9 Claims, 6 Drawing Sheets

FOLDING ROCKING CHAIR

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to collapsible chairs.

General Background

Collapsible chairs are commonly used in both outdoor settings and indoor settings. Collapsible chairs of the type that collapse in both width and depth have become more common than previous folding chairs that merely fold flat in one dimension. This is primarily due to the fact that such chairs are often more portable and easier to store. Collapsible chairs may also include roll tubes to form a rocking chair. One drawback to common collapsible rocking chairs that collapse in both width and depth is that some support members must be decoupled from the roll tubes in order to collapse the chair, and it is difficult to recouple the support members to the roll tubes when expanding the chair.

SUMMARY OF THE INVENTION

In an aspect of the invention, a collapsible rocking chair is adapted and configured to adjust between an expanded configuration and a collapsed configuration. The chair includes a pair of front cross members, a pair of rear cross members, a pair of rear seat support members, a pair of roll tubes, a left side member, a right side member, a left front seat support member, a right front seat support member, a right guiding member, and a left guiding member.

The pair of front cross members includes first and second front cross members. The first and second front cross members are pivotally coupled to each other in a crossed manner, and the first and second front cross members each have a first end and a second end opposite the first end.

The pair of rear cross members include a first and a second rear cross member. The first and second rear cross members are pivotally coupled to each other in a crossed manner, and the first and second rear cross members each have a first end and second end opposite the first end.

The pair of rear seat support members includes a left and a right rear seat support member. Each of the left and right rear seat support members has a first end and a second end opposite the first end. The left rear seat support member is pivotally and slideably coupled to the first end of the first rear cross member. The right rear seat support member is pivotally and slideably coupled to the first end of the second rear cross member.

The pair of roll tubes includes a left and a right roll tube. The left and right roll tubes each have a first end and second end opposite the first end. The left and right roll tubes are configured to provide for a rocking motion.

The left side member has a first end and a second end opposite the first end. The first end is pivotally and slideably coupled to the left rear seat support member, and the second end is pivotally coupled to the first end of the left roll tube. The left side member has a bend at an obtuse angle. The right side member has a first end and second end opposite the first end. The first end is pivotally and slideably coupled to the right rear seat support member, and the second end is pivotally coupled to the first end of the right roll tube. The right side member is bent at an obtuse angle.

The left front seat support member has a first end and second end opposite the first end. The first end of the left front seat support member is pivotally coupled to the first end of the first front cross member, and the second end of the left front seat support member is engageable with the second end of the left roll tube. The left front seat support member is also pivotally coupled to the second end of the left rear seat support member between the first and second ends of the left front seat support member. The right front seat support member has a first end and second end opposite the first end. The first end of the right front seat support member is pivotally coupled to the first end of the second front cross member, and the second end of the right front seat support member is engageable with the second end of the right roll tube. The right front seat support member is further pivotally coupled to the second end of the right rear seat support member between the first and second ends of the right front seat support member.

The right and left guiding members each have a first end and a second end opposite the first end. The first end of the left guiding member is pivotally coupled to the second end of the left front seat support member, and the second end of the left guiding member is pivotally coupled to the left roll tube between the first and second ends of the left roll tube. The first end of the right guiding member is pivotally coupled to the second end of the right front seat support member. The second end of the right guiding member is pivotally coupled to the right roll tube between the first and second ends of the right roll tube.

Further features and advantages of the present invention, as well as the structure and operation of various embodiments of the present invention, are described in detail below with reference to the accompanying drawings.

Figure 1:
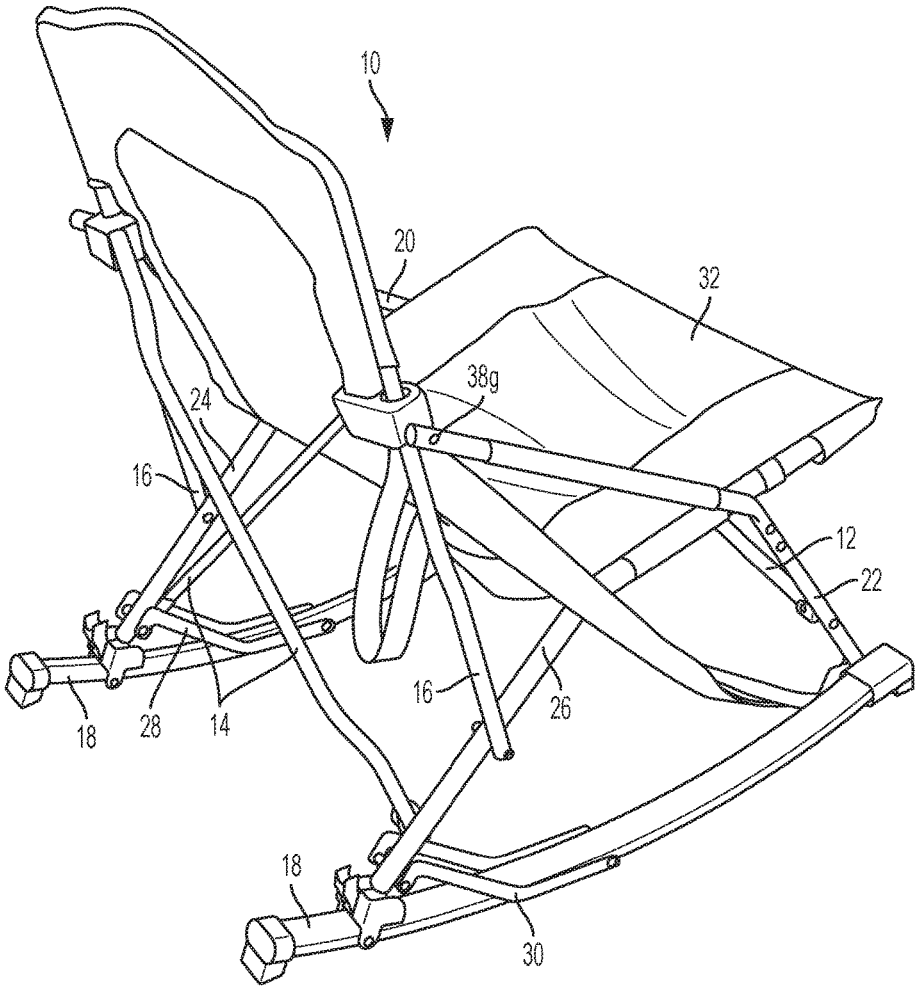
FIG. 1 depicts a perspective view of a preferred embodiment of a collapsible rocking chair in its expanded configuration, showing the top, rear, and right thereof.
Figure 2:
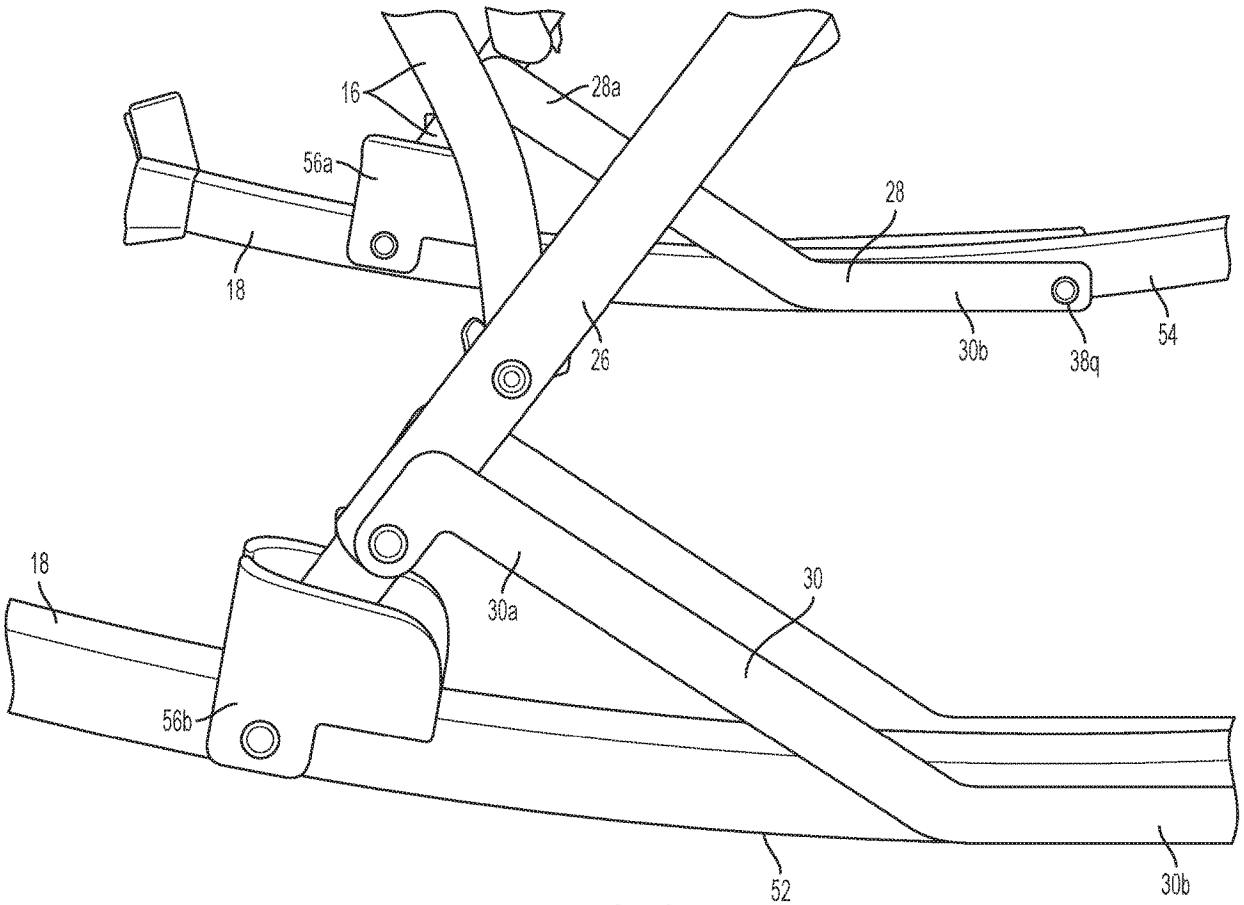
FIG. 2 depicts a partial detail view of a guiding member of the collapsible rocking chair illustrated in FIG. 1, the partial detail view showing a right perspective view of the collapsible rocking chair.

Reference numerals in the written specification and in the drawing figures indicate corresponding items.

DETAILED DESCRIPTION OF THE PREFERRED EMBODIMENT

A preferred embodiment of a collapsible rocking chair 10 in accordance with the invention is shown in its entirety in FIG. 1 and partially shown in FIGS. 2-6. The collapsible rocking chair 10 includes a pair of front cross members 12, a pair of rear cross members 14, a pair of rear seat support members 16, a pair of roll tubes 18, a left side member 20, a right side member 22, a left front seat support member 24, a right front seat support member 26, a left guiding member 28, and a right guiding member 30. The collapsible rocking chair 10 is adjustable between a collapsed configuration and an expanded configuration. In the expanded configuration, the collapsible rocking chair 10 is usable as a rocking chair. In the collapsed configuration, the collapsible rocking chair 10 has a reduced foot print and is folded in both length and width. Therefore, the collapsible rocking chair 10 is portable by being collapsible.

The pair of rear seat support members 16 and the left and right front seat support members 24, 26 support a seat 32. For example, and without limitation, the seat 32 includes a plurality of pockets and/or loops that receive the ends of the pair of rear seat support members 16 and the left and right front seat support members 24, 26. The seat 32 is adapted and configured such that the seat 32 does not limit the collapsing of the collapsible chair 10 due to its foldable characteristics. For example, and without limitation, the seat 32 is constructed of a fabric that allows the seat 32 to be supported when the collapsible chair 10 is in an expanded configuration and also does not impede the motion of the members of the collapsible rocking chair 10 from the expanded configuration to the collapsed configuration.

Figure 3:
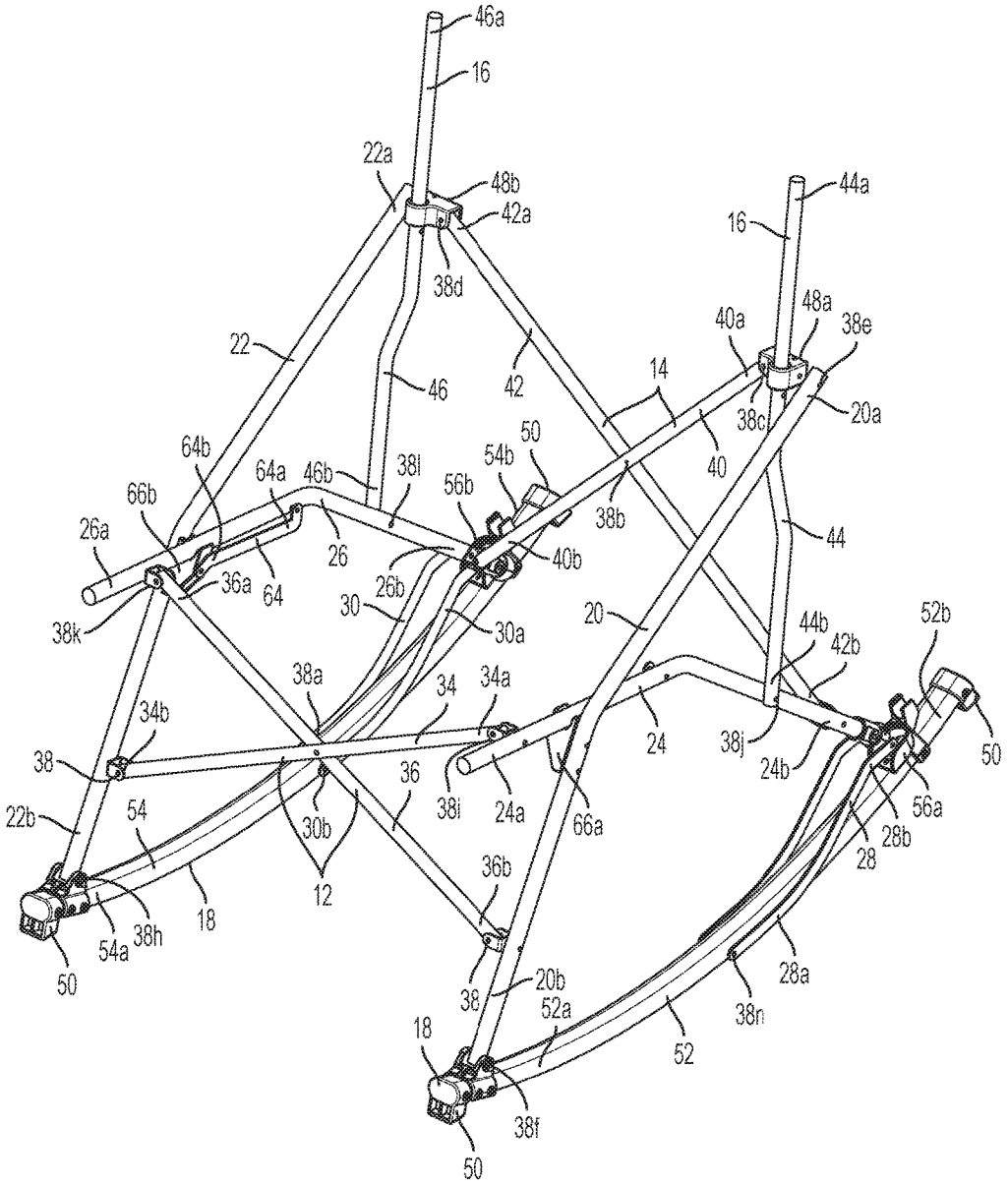
FIG. 3 depicts a perspective partial view of the collapsible rocking chair illustrated in FIG. 1, showing the top, front, and left thereof.
Figure 4:
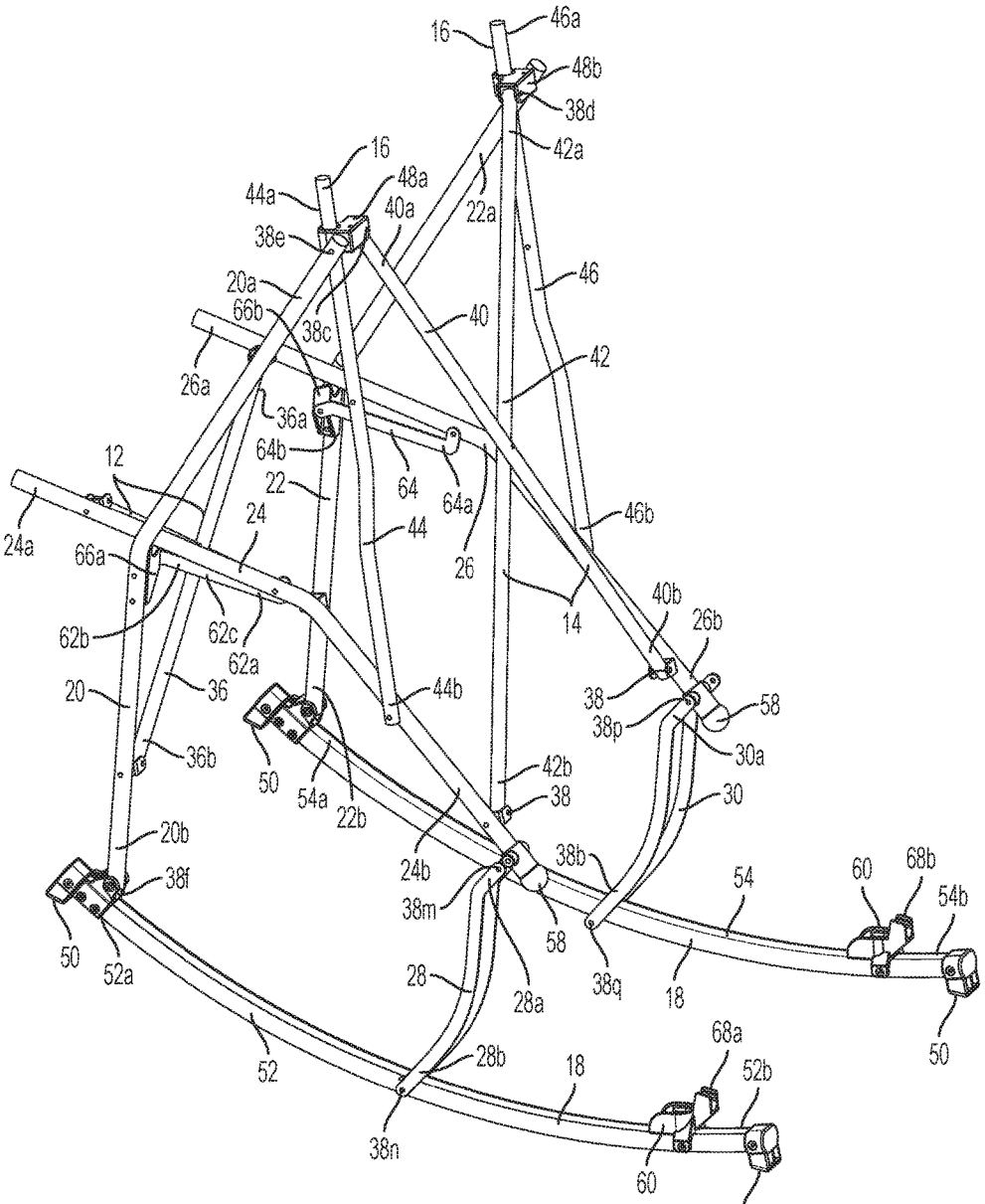
FIG. 4 depicts a perspective view of the collapsible rocking chair illustrated in FIG. 3 in a partially collapsed configuration, showing the top, rear, and left thereof.

As shown at least in FIGS. 3 and 4, the pair of front cross members 12 includes a first front cross member 34 and a second front cross member 36. The first front cross member 34 and the second front cross member 36 are pivotally coupled to each other in a crossed manner. The first front cross member 34 and the second front cross member 36 are coupled to each other via a fastener 38 *a*. For example, and without limitation, fastener 38 *a* is a rivet, nut and bolt, or similar fastener that allows for rotation of the first and second front cross members 34, 36. The first front cross member 34 has a first end 34 *a* and a second end 34 *b* opposite the first end 34 *a*. The second front cross member 36 has a first end 36 *a* and a second end 36 *b* opposite the first end 36 *a*.

The pair of rear cross members 14 includes a first rear cross member 40 and a second rear cross member 42. The first rear cross member 40 and the second rear cross member 42 are pivotally coupled to each other in a crossed manner via a fastener 38 *b*. The first rear cross member 40 has a first end 40 *a* and a second end 40 *b* opposite the first end 40 *a*. The second rear cross member 42 similarly has a first end 42 *a* and a second end 42 *b* opposite the first end 42 *a*.

The pair of rear seat support members 16 include a left rear seat support member 44 and a right rear seat support member 46. The left rear seat support member 44 has a first end 44 *a* and a second end 44 *b* opposite the first end 44 *a*. The right rear seat support member 46 having a first end 46 *a* and a second end 46 *b* opposite the first end 46 *a*. The left rear seat support member 44 is pivotally and slideably coupled to the first end 40 *a* of the first rear cross member 40. The right rear seat support member 46 is pivotally and slideably coupled to the first end 42 *a* of the second rear cross member 42. In some embodiments, the first end 40 *a* of the first rear cross member 40 is slideably and pivotally coupled to the left rear seat support member 44 via a sliding bracket 48 *a* and a fastener 38 *c*. The first rear cross member 40 is thus allowed to rotate relative to the left rear seat support member 44 in a plane that is substantially perpendicular to a plane in which the left rear seat support member 44 is positioned. The sliding bracket 48 *a* further allows the first end 40 *a* of the first rear cross member 40 to slide along the left rear seat support member 44.

The first end 42 *a* of the second rear cross member 42 is slideably and pivotally coupled to the right rear seat support member 46. In some embodiments, the first end 42 *a* of the second rear cross member 42 is slideably and pivotally coupled to the right rear seat support member 46 via a sliding bracket 48 *b* and a fastener 38 *d*. The second rear cross member 42 is thus allowed to rotate relative to the right rear seat support member 46 in a plane that is substantially perpendicular to a plane in which the right rear seat support member 46 is positioned. The sliding bracket 48 *b* further allows the first end 42 *a* of the second rear cross member 42 to slide along the right rear seat support member 46.

In some embodiments, the rear seat support members 16 are coupled to the outer sides of the left front seat support member 24 and the right front seat support member 26, and the rear seat support members 16 each include two bends such that the first ends 44 *a*, 46 *a* are positioned above the front seat support members 24, 26 and are in the same plane as the respective front seat support member 24, 26.

The pair of roll tubes 18 included in the collapsible chair 10 are curved in order to allow a user to rock the collapsible chair 10 along the curve formed by the pair of roll tubes 18. In some embodiments, a stop 50 is positioned on one or more ends of the pair of roll tubes 18. The stops 50 are adapted and configured to limit the degree to which the collapsible chair 10 may be rocked by a user. At a certain degree of rock, the stop 50 engages with the ground and prevents further rocking in that direction.

The pair of roll tubes 18 include a left roll tube 52 and a right roll tube 54. The left roll tube 52 includes a first end 52 *a* and a second end 52 *b* opposite the first end 52 *a*. The right roll tube 54 includes a first end 54 *a* and a second end 54 *b* opposite the first end 52 *a*. The first and second roll tubes 52, 54 are coupled to the other members of the collapsible chair 10 as described herein to allow the collapsible chair 10 to both function as a rocking chair in the expanded configuration and fold into a collapsed configuration having a smaller footprint.

The left side member 20 of the collapsible chair 10 has a first end 20 *a* and a second end 20 *b* opposite the first end 20 *a*. The first end 20 *a* is pivotally and slideably coupled to the left rear seat support member 44. In some embodiments, the first end 20 *a* is coupled to the sliding bracket 48 *a* via a fastener 38 *e*. The second end 20 *b* of the left side member 20 is pivotally coupled to the first end 52 *a* of the left roll tube 52. Preferably, the second end 20 *b* is pivotally coupled to the left role tube 52 via a fastener 38 *f* and/or a corresponding bracket. In some embodiments, the left side member 20 has a bend at an obtuse angle. This bend may facilitate the folding of the collapsible chair 10 into the collapsed configuration.

The right side member 22 of the collapsible chair 10 has a first end 22 *a* and a second end 22 *b* opposite the first end 22 *a*. The first end 22 *a* is pivotally and slideably coupled to the right rear seat support member 46. In some embodiments, the first end 22 *a* is coupled to the sliding bracket 48

*b* via a fastener 38 *g*. The second end 22 *b* is pivotally coupled to the first end 54 *a* of the right roll tube 54. Preferably, the second end 22 *b* is pivotally coupled to the right roll tube 54 via a fastener 38 *h* and/or a corresponding bracket. In some embodiments, the right side member 22 has a bend at an obtuse angle. This bend may facilitate the folding of the collapsible chair 10 into the collapsed configuration.

The left front seat support member 24 of the collapsible chair 10 has a first end 24 *a* and a second end 24 *b* opposite the first end 24 *a*. The first end 24 *a* of the left front seat support member 24 is pivotally coupled to the first end 34 *a* of the first front cross member 34. Preferably, the first cross member 34 is pivotally coupled to the left front seat support 24 via a fastener 38 *i* and a bracket such that the first cross member 34 may pivot in a plane substantially perpendicular to a plane in which the left front seat support member 24 is positioned. The second end 24 *b* of the left front seat support member 24 is engageable with the second end 52 *b* of the left roll tube 52. The second end 24 *b* of the left front seat support member 24 can engage with the second end 52 *b* such that the left front seat support member 24 is partially supported and/or disengageably coupled to the left roll tube 52. Any releasable connector may be used to engage the left front seat support member 24 with the left roll tube 52.

Preferably, the collapsible chair 10 includes a first releasable fastener 56 *a* coupled to one or more of the second end 24 *b* of the right front seat support member 24 and the second end 52 *b* of the left roll tube 52. The first releasable fastener 56 *a* is adapted and configured to releasably secure the second end 24 *b* of the left front seat support member 24 to the second end 52 *b* of the left roll tube 52 when engaged. In some embodiments, the first releasable fastener 56 *a* includes a male connector 58 and a female connector 60. The male 58 and female 60 connectors are adapted and configured to cooperate to form a releasable connection. For example, and without limitation, the male connector 58 is generally spherical or a partial sphere. The male connector may be a sphere with a sphere cap removed and the remaining partial sphere coupled to the second end 24 *b* of the left front seat support member 24. The female connector 60 is a socket sized to releasably and secureably receive the sphere portion of the male connector 58. In alternative embodiments, other types of releasable connectors or engaging systems may be used. For example, and without limitation, a pin and receiving hole may be used.

The left front seat support member 24 is further coupled to the left rear seat support member 44. Preferably, the left front seat support member 24 is pivotally coupled to the second end 44 *b* of the left rear seat support member 44 between the first end 24 *a* and the second end 24 *b* of the left front seat support member 24. The left front seat support member 24 is pivotally coupled to the second end 44 *b* of the left rear seat support member 44 via a fastener 38 *j*. In some embodiments, the left front seat support member 24 includes a bend and is angled at an obtuse angle. This bend positions the seat 32 for use when the collapsible chair 10 is in the expanded configuration. The left front seat support member 24 is pivotally coupled to the second end 44 *b* of the left rear seat support member 44 preferably between the bend and the second end 24 *b* of the left front seat support member 24.

The collapsible chair 10 further includes a right front seat support member 26 similar to the left front seat support member 24. The right front seat support member 26 includes a first end 26 *a* and second end 26 *b* opposite the first end 26 *a*. The first end 26 *a* of the right front seat support 26 member is pivotally coupled to the first end 36 *a* of the second front cross member 36 via a fastener 38 *k*. The second end 26 *b* of the right front seat support member 26 is engageable with the second end 54 *b* of the right roll tube 54 in the same or a similar manner as described above with respect to the left front seat support member 24. The right front seat support member 26 is pivotally coupled to the second end 46 *b* of the right rear seat support member 46 between the first end 26 *a* and the second end 26 *b* of the right front seat support member 26. The right front seat support member 26 is pivotally coupled to the second end 46 *b* of the right rear seat support member 46 via a fastener 38 *l*. As described above with respect to the left front seat support member 24, the right front seat support member 26 may include a bend to create an obtuse angle. The right front seat support member 26 is pivotally coupled to the second end 46 *b* between the bend and the second end 26 *b* of the right front seat support member 26.

In the preferred embodiment, the right front seat support member 26 engages with the right roll tube 54 using a second releasable fastener 56 *b* coupled to one or more of the second end 26 *b* of the right front seat support member 26 and the second end 54 *b* of the right roll tube 54. The second releasable fastener 56 *b* is adapted and configured to releasably secure the second end 26 *b* of the right front seat support member 26 to the second end 54 *b* of the right roll tube 54 when engaged. Preferably, the right front seat support member engages with the right roll tube via the releasable fastener described above (e.g., a partial sphere male connector 58 coupled to the second end 56 *b* of the right front seat support member 26 and a female socket connector 60 coupled to the second end 54 *b* of the right role tube 54 that are adapted and configured to be releasably coupled). In alternative embodiments, other releasable fasteners are used.

In some embodiments, the collapsible chair 10 further includes a left linking member 62 and a right linking member 64. The left and right linking members 62 *a*, 62 *b* further couple the front seat support members 24, 26 to the left and right side members 20, 22 respectively. The left linking member 62 has a first end 62 *a* and a second end 62 *b* opposite the first end 62 *a*. Similarly, the right linking member 64 has a first end 64 *a* and a second end 64 *b* opposite the first end 64 *a*. The first end 62 *a* of the left linking member 62 is pivotally coupled to the left front seat support member 24 between the first end 24 *a* and the second end 24 *b* of the left front seat support member 24. Preferably, the first end 62 *a* of the left linking member 62 is pivotally coupled to the left front seat support member 24 between the first end 24 *a* of the left front seat support member 24 and a bend in the left front seat support member 24 via a fastener 38. The second end 62 *b* of the left linking member 62 is pivotally coupled to the left side member 20. Preferably, the left linking member 62 is pivotally coupled to the left side member 20 via a fastener 38 and/or a bracket.

The first end 64 *a* of the right linking member 64 is pivotally coupled to the right front seat support member 26 between the first end 26 *a* and the second end 26 *b* of the right front seat support member 26. Preferably, the first end 64 *a* of the right linking member 64 is pivotally coupled to the right front seat support member 26 between the first end 26 *a* of the right front seat support member 26 and a bend in the right front seat support member 26 via a fastener 38. The second end 64 *b* of the right linking member 64 is pivotally coupled to the right side member 22. Preferably, the right linking member 64 is pivotally coupled to the right side member 22 via a fastener 38 and/or a bracket.

In some embodiments, the collapsible chair 10 further includes a left support bracket 66 *a* and a right support bracket 66 *b*. The left support bracket 66 *a* is coupled to the left side member 20 and is adapted and configured to releasably receive the left front seat support member 24 when the collapsible chair 10 is in the expanded configuration. For example, and without limitation, the support brackets 66 *a*, 66 *b* extend outward and vertically and include a channel which can receive front seat support members 24, 26. The right support bracket 66 *b* is coupled to the right side member 22 and is adapted and configured to releasably receive the right front seat support member 26 when the collapsible chair 10 is in the expanded configuration. In some embodiments, the left linking member 62 is pivotally coupled to the left support bracket 66 *a* and the right linking member 64 is pivotally coupled to the right support bracket 66 *b*.

Advantageously, the linking members 62, 64 provide increased strength and rigidity to the collapsible chair 10 and further provide for alignment between the front seat support members 24, 26 and corresponding support brackets 66 *a*, 66 *b*. Therefore, a user expanding the collapsible chair 10 does not have to manually align the front seat support member 24, 26 with the corresponding support brackets 66 *a*, 66 *b*. The linking members 62, 64 further aid in the alignment of the front seat support members 24, 26 with the roll tubes 52, 54. Therefore, a user expanding the collapsible chair 10 does not have to manually align the releasable fasteners 56 *a*, 56 *b*. In alternative embodiments, the collapsible chair 10 may not include linking members 62, 64.

The collapsible chair 10 includes the left guiding member 28 and the right guiding member 30 for aligning the front seat support members 24, 26 and the roll tubes 52, 54. Advantageously, a user expanding the collapsible chair 10 does not have to manually align the releasable fasteners 56 *a*, 56 *b* as alignment is provided, at least in part, by the guiding members 28, 30. The left guiding member 28 has a first end 28 *a* and a second end 28 *b* opposite the first end 28 *a*. Similarly, the right guiding member 30 has a first end 30 *a* and a second end 30 *b* opposite the first end 30 *a*. The first end 28 *a* of the left guiding member 28 is pivotally coupled to the second end 24 *b* of the left front seat support member 24 via a fastener 38 *m*. The second end 28 *b* of the left guiding member 28 is pivotally coupled to the left roll tube 52 between the first end 52 *a* and second end 52 *b* of the left roll tube 52 via a fastener 38 *n*. The first end 30 *a* of the right guiding member 30 is pivotally coupled to the second end 26 *b* of the of the right front seat support member 26 via a fastener 38 *p*. The second end 30 *b* of the right guiding member 30 is pivotally coupled to the right roll tube 54 between the first end 54 *a* and the second end 54 *b* of the right roll tube 54 via a fastener 38 *q*.

In some embodiments, the guiding members 28, 30 have one or more curved portions and/or one or more bends. These features prevent the guiding members 28, 30 from impeding the rocking motion provide by roll tubes 52, 54. The guiding member 28, 30 follow the countors of the roll tubes 52, 54 or are above the roll tubes 52, 54. Preferably, the guiding members 28, 30 include two parallel portions one either side of the corresponding roll tube 52, 54. In alternative embodiments, the guiding members 28, 30 may be only a single member or portion located on one side of the corresponding role tube 52, 54.

The right guiding member 30 is adapted and configured to align the right roll tube 54 and the front right seat support member 26 in a first plane as the collapsible chair 10 is adjusted into the expanded configuration. As described above, this facilitates alignment and engagement of the right releasable fastener 56 *b*. The left guiding member 28 is adapted and configured to align the left roll tube 52 and the front left seat support member 24 in a second plane as the collapsible chair 10 is adjusted into the expanded configuration. As described above, this facilitates alignment and engagement of the left releasable fastener 56 *a*.

Figure 5:
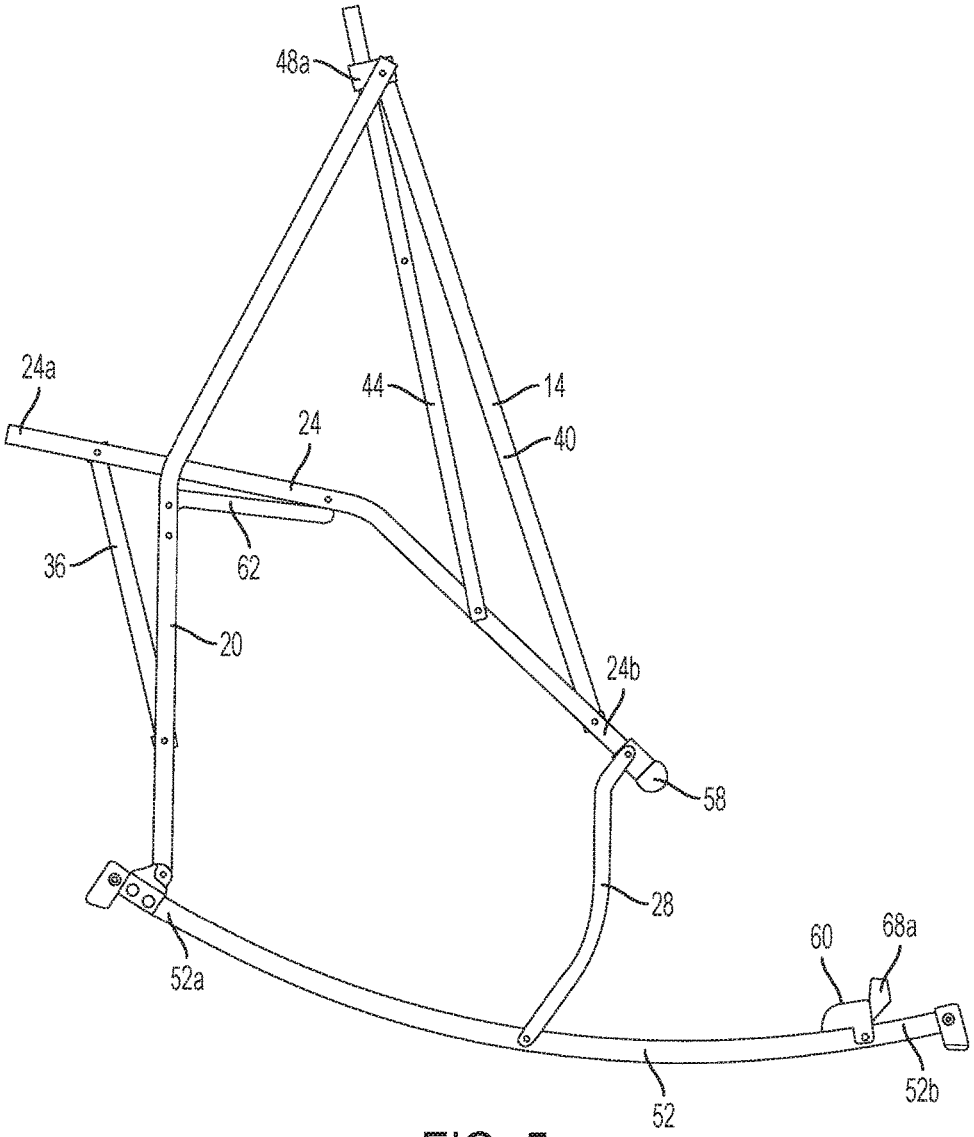
FIG. 5 depicts a left side view of the collapsible rocking chair illustrated in FIG. 4 in a further partially collapsed configuration.
Figure 6:
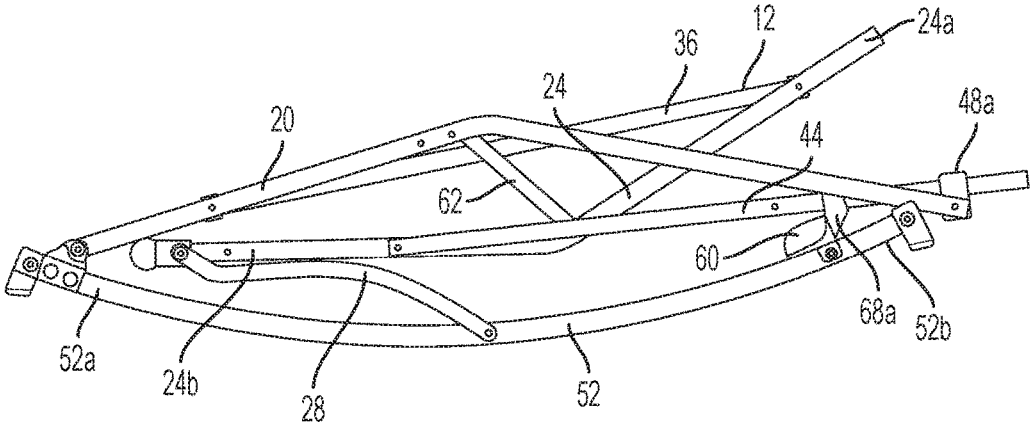
FIG. 6 depicts a left side view of the collapsible rocking chair illustrated in FIG. 5 in a fully collapsed configuration.

Referring now to FIGS. 1 and 3-6, the collapsible chair 10 is adjustable between expanded and collapsed configurations. To adjust the collapsible chair 10 from the expanded configuration to the collapsed configuration, a user disengages the releasable fasteners 56 *a*, 56 *b*. For example, and without limitation, the user may secure one or more of the roll tubes 52, 54 using their foot and provide an upward and/or forward force on one or more of the pair of rear seat support members or side members 20, 22. As shown in FIGS. 4 and 5, this results in the releasable fasteners 56 *a*, 56 *b* being disengaged so that, for example, the male connectors 58 and female connectors 60 are separated. Furthermore, the angle between the guiding members 28, 30 and the corresponding role tube 52, 54 is increased. The angle between the linking members 62, 64 and the corresponding front seat support member 24, 26 also increases. The angle between the side members 20, 22 and the corresponding role tubes 52, 54 is increased.

The user continues folding the collapsible chair 10 such that the second ends 24 *b*, 26 *b* of the front seat support members 24, 26 are moved forward toward the first ends 52 *a*, 54 *a* of the role tubes 52, 54. The angle between the guiding members 28, 30 and the second ends 52 *b*, 54 *b* of the role tubes 52, 54 continues to increase. Throughout the motion, the sliding brackets 48 *a*, 48 *b* are allowed to slide along the rear seat support members 44, 46.

To complete the folding of the collapsible chair 10 into the collapsed configuration, the angle between the side members 20, 22 and the role tubes is decreased and the front seat support members 24, 26 rotate. The front seat support members 24, 26 rotate such that the first ends 24 *a*, 26 *a* move from a position forward of the roll tubes 52, 54 to a position nearer the second ends 52 *b*, 54 *b* of the roll tubes 52, 54. The angle between the guiding members 28, 30 and the second ends 52 *b*, 54 *b* of the role tubes 52, 54 further to increases. The angle between the linking members 62, 64 and the corresponding front seat support member 24, 26 also increases. Furthermore, the angle between the plane in which the pair of front cross members 12 are positioned and the roll tubes 52, 54 is reduced. The pair of front cross members 12 are positioned, generally, over the roll tubes 52, 54.

Furthermore, the collapsible chair 10 is folded to reduce its width. The pair of front cross members 12 and the pair of rear cross members 14 are folded such that the roll tubes 52, 54 are brought closer together widthwise, the left front seat support member 24 and the right front seat support member 26 are brought closer together widthwise, and the left rear seat support member 44 and the right rear seat support member 46 are brought closer together widthwise. The first front cross member 34 and the second front cross member 36 pivot about the fastener 38 *a* such that the first end 34 *a* of the first front cross member and the first end 36 *a* of the second front cross member 36 are moved closer to one another widthwise. Similarly, the first rear cross member 40 and the second rear cross member 42 pivot about the fastener 38 *b* such that the first end 40 *a* of the first rear cross member and the first end 42 *a* of the second rear cross member 42 are moved closer to one another widthwise.

In some embodiments, the collapsible chair includes one or more securing brackets 68. The securing brackets 68 include a channel or other feature for receiving and releasably securing one member to another member to which the securing bracket 68 is permanently attached in normal operation of the collapsible chair. Preferably, the collapsible chair 10 includes a left securing bracket 68 *a* and a right securing bracket 68 *b*. The left securing bracket 68 *a* is coupled to the left roll tube 52 and releasably secures the left rear seat support member 44 when the collapsible chair 10 is in the collapsed configuration. The right securing bracket 68 *b* is coupled to the right roll tube 54 and releasably secures the right rear seat support member 46 when the collapsible chair 10 is in the collapsed configuration. Advantageously, the securing brackets 68 *a*, 68 *b* increase the amount of force needed to begin transitioning the collapsible chair 10 from the collapsed configuration to the expanded configuration. This may reduce inadvertent expansion or partial expansion of the collapsible chair 10 from the collapsed configuration and/or maintain the collapsible chair 10 in the space saving collapsed configuration unless otherwise desired by the user.

As a result of the motion(s), the collapsible chair 10 is reduced in both width and height from the expanded configuration. To transition the collapsible chair 10 from the collapsed configuration into the expanded configuration the above described motions are reversed. In transitioning the collapsible chair 10 into the expanded configuration, the guiding members 28, 30 and/or the linking members 62, 64 facilitate alignment of the members of the collapsible chair 10 as described herein. Thus, the user does not need to manually align the releasable fasteners 56 *a*, 56 *b* which when engaged secure the collapsible chair 10 in the expanded configuration.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents. It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A collapsible rocking chair adapted and configured to adjust between an expanded configuration and a collapsed configuration, the chair comprising:

a pair of front cross members including first and second front cross members, the first and second front cross members being pivotally coupled to each other in a crossed manner, the first and second front cross members each having a first end and a second end opposite the first end;

a pair of rear cross members including first and second rear cross members, the first and second rear cross members being pivotally coupled to each other in a crossed manner, the first and second rear cross members each having a first end and second end opposite the first end;

a pair of rear seat support members including a left and right rear seat support member, each of the left and right rear seat support member having a first end and a second end opposite the first end, the left rear seat support member pivotally and slideably coupled to the first end of the first rear cross member, the right rear seat support member pivotally and slideably coupled to the first end of the second rear cross member;

a pair of roll tubes including left and right roll tubes, the left and right roll tubes each having a first end and second end opposite the first end;

a left side member having a first end and a second end opposite the first end, the first end pivotally and slideably coupled to the left rear seat support member, the second end pivotally coupled to the first end of the left roll tube, the left side member having a bend at an obtuse angle;

a right side member having a first end and second end opposite the first end, the first end pivotally and slideably coupled to the right rear seat support member, the second end pivotally coupled to the first end of the right roll tube, the right side member having a bend at an obtuse angle;

a left front seat support member having a first end and second end opposite the first end, the first end of the left front seat support member pivotally coupled to the first end of the first front cross member, the second end of the left front seat support member engageable with the second end of the left roll tube, the left front seat support member pivotally coupled to the second end of the left rear seat support member between the first and second ends of the left front seat support member;

a right front seat support member having a first end and second end opposite the first end, the first end of the right front seat support member pivotally coupled to the first end of the second front cross member, the second end of the right front seat support member engageable with the second end of the right roll tube, the right front seat support member pivotally coupled to the second end of the right rear seat support member between the first and second ends of the right front seat support member; and a right and left guiding member each having a first end and a second end opposite the first end, the first end of the left guiding member pivotally coupled to the second end of the left front seat support member, the second end of the left guiding member pivotally coupled to the left roll tube between the first and second ends of the left roll tube, the first end of the right guiding member pivotally coupled to the second end of the of the right front seat support member, the second end of the right guiding member pivotally coupled to the right roll tube between the first and second ends of the right roll tube.

2. A collapsible rocking chair in accordance with claim 1 wherein the right guiding member is adapted and configured to align the right roll tube and the front right seat support member in a first plane as the collapsible chair is adjusted into the expanded configuration, and the left guiding member is adapted and configured to align the left roll tube and the front left seat support member in a second plane as the collapsible chair is adjusted into the expanded configuration.

3. A collapsible rocking chair in accordance with claim 1 further comprising left and right linking members each having a first end and a second end opposite the first end, the first end of the left linking member pivotally coupled to the left front seat support member between the first and second ends of the left front seat support member, the second end of the left linking member pivotally coupled to the left side member, the first end of right linking member pivotally coupled to the right front seat support member between the first and second ends of the right front seat support member, the second end of the right linking member pivotally coupled to the right side member.

4. A collapsible rocking chair in accordance with claim 1 wherein the first end of the first rear cross member and the first end of the left side member are slideably and pivotally coupled to the left rear seat support member via a sliding bracket.

5. A collapsible rocking chair in accordance with claim 1 further comprising a left and right support bracket, the left support bracket coupled to the left side member and adapted and configured to releasably receive the left front seat support member when the collapsible chair is in the expanded configuration, the right support bracket coupled to the right side member and adapted and configured to releasably receive the right front seat support member when the collapsible chair is in the expanded configuration.

6. A collapsible rocking chair in accordance with claim 1, wherein the first end of the second rear cross member and the first end of the right side member are slideably and pivotally coupled to the right rear seat support member via a sliding bracket.

7. A collapsible rocking chair adapted and configured to adjust between an expanded configuration and a collapsed configuration, the chair comprising:

a pair of front cross members including first and second front cross members, the first and second front cross members being pivotally coupled to each other in a crossed manner, the first and second front cross members each having a first end and a second end opposite the first end;

a pair of rear cross members including first and second rear cross members, the first and second rear cross members being pivotally coupled to each other in a crossed manner, the first and second rear cross members each having a first end and second end opposite the first end;

a pair of rear seat support members including a left and right rear seat support member, each of the left and right rear seat support member having a first end and a second end opposite the first end, the left rear seat support member pivotally and slideably coupled to the first end of the first rear cross member, the right rear seat support member pivotally and slideably coupled to the first end of the second rear cross member;

a pair of roll tubes including left and right roll tubes, the left and right roll tubes each having a first end and second end opposite the first end;

a left side member having a first end and a second end opposite the first end, the first end pivotally and slideably coupled to the left rear seat support member, the second end pivotally coupled to the first end of the left roll tube, the left side member having a bend at an obtuse angle;

a right side member having a first end and second end opposite the first end, the first end pivotally and slideably coupled to the right rear seat support member, the second end pivotally coupled to the first end of the right roll tube, the right side member having a bend at an obtuse angle;

a left front seat support member having a first end and second end opposite the first end, the first end of the left front seat support member pivotally coupled to the first end of the first front cross member, the second end of the left front seat support member engageable with the second end of the left roll tube, the left front seat support member pivotally coupled to the second end of the left rear seat support member between the first and second ends of the left front seat support member;

a right front seat support member having a first end and second end opposite the first end, the first end of the right front seat support member pivotally coupled to the first end of the second front cross member, the second end of the right front seat support member engageable with the second end of the right roll tube, the right front seat support member pivotally coupled to the second end of the right rear seat support member between the first and second ends of the right front seat support member;

a right and left guiding member each having a first end and a second end opposite the first end, the first end of the left guiding member pivotally coupled to the second end of the left front seat support member, the second end of the left guiding member pivotally coupled to the left roll tube between the first and second ends of the left roll tube, the first end of the right guiding member pivotally coupled to the second end of the of the right front seat support member, the second end of the right guiding member pivotally coupled to the right roll tube between the first and second ends of the right roll tube; and a first releasable fastener coupled to one or more of: (i) the second end of the left front seat support member, (ii) the right front seat support member, (iii) the second end of the left roll tube, and (iv) the second end of the right roll tube, the first releasable fastener adapted and configured to releasably secure at least one of: (y) the second end of the left front seat support member to the second end of the left roll tube when engaged, and (z) the right front seat support member to the second end of the right roll tube when engaged.

8. A collapsible rocking chair adapted and configured to adjust between an expanded configuration and a collapsed configuration, the chair comprising:

a pair of front cross members including first and second front cross members, the first and second front cross members being pivotally coupled to each other in a crossed manner, the first and second front cross members each having a first end and a second end opposite the first end;

a pair of rear cross members including first and second rear cross members, the first and second rear cross members being pivotally coupled to each other in a crossed manner, the first and second rear cross members each having a first end and second end opposite the first end;

a pair of rear seat support members including a left and right rear seat support member, each of the left and right rear seat support member having a first end and a second end opposite the first end, the left rear seat support member pivotally and slideably coupled to the first end of the first rear cross member, the right rear seat support member pivotally and slideably coupled to the first end of the second rear cross member;

a pair of roll tubes including left and right roll tubes, the left and right roll tubes each having a first end and second end opposite the first end;

a left side member having a first end and a second end opposite the first end, the first end pivotally and slideably coupled to the left rear seat support member, the second end pivotally coupled to the first end of the left roll tube, the left side member having a bend at an obtuse angle;

a right side member having a first end and second end opposite the first end, the first end pivotally and slideably coupled to the right rear seat support member, the second end pivotally coupled to the first end of the right roll tube, the right side member having a bend at an obtuse angle;

a left front seat support member having a first end and second end opposite the first end, the first end of the left front seat support member pivotally coupled to the first end of the first front cross member, the second end of the left front seat support member engageable with the second end of the left roll tube, the left front seat support member pivotally coupled to the second end of the left rear seat support member between the first and second ends of the left front seat support member;

a right front seat support member having a first end and second end opposite the first end, the first end of the right front seat support member pivotally coupled to the first end of the second front cross member, the second end of the right front seat support member engageable with the second end of the right roll tube, the right front seat support member pivotally coupled to the second end of the right rear seat support member between the first and second ends of the right front seat support member;

a right and left guiding member each having a first end and a second end opposite the first end, the first end of the left guiding member pivotally coupled to the second end of the left front seat support member, the second end of the left guiding member pivotally coupled to the left roll tube between the first and second ends of the left roll tube, the first end of the right guiding member pivotally coupled to the second end of the of the right front seat support member, the second end of the right guiding member pivotally coupled to the right roll tube between the first and second ends of the right roll tube; and a first and second female connector and a first and second male connector, the male and female connectors adapted and configured to cooperate to form releasable connections, the first male connector coupled to the second end of the left front seat support member, the second male connector coupled to the second end of the right front seat support member, the first female connector coupled to the second end of the left roll tube, and the second female connector coupled to the second end of the right roll tube.

9. A collapsible rocking chair in accordance with claim 8 wherein the first and second male connectors are generally spherical and wherein the first and second female connectors are sockets adapted and configured to releasably receive the generally spherical male connectors.

* * * * *